US010934625B2

(12) United States Patent
Dalbin et al.

(10) Patent No.: US 10,934,625 B2
(45) Date of Patent: Mar. 2, 2021

(54) PROCESS FOR METALLIZATION OF AN ARTICLE HAVING A PLASTIC SURFACE AVOIDING THE METALLIZATION OF THE RACK WHICH FIXES THE ARTICLE WITHIN THE PLATING BATH

(71) Applicant: COVENTYA S.P.A., Carugo (IT)

(72) Inventors: Sandrine Dalbin, Treviso (IT); Nicolas Pommier, Asnières sur Seine (FR); Gianluigi Schiavon, Treviso (IT); Peter Pies, Cologne (DE)

(73) Assignee: Coventya S.P.A., Carugo (IT)

( * ) Notice: Subject to any disclaimer, the term of this patent is extended or adjusted under 35 U.S.C. 154(b) by 137 days.

(21) Appl. No.: 16/090,599

(22) PCT Filed: Mar. 31, 2017

(86) PCT No.: PCT/EP2017/057766
§ 371 (c)(1),
(2) Date: Oct. 2, 2018

(87) PCT Pub. No.: WO2017/174470
PCT Pub. Date: Oct. 12, 2017

(65) Prior Publication Data

US 2019/0112712 A1 Apr. 18, 2019

(30) Foreign Application Priority Data

Apr. 4, 2016 (EP) ..... 16163748

(51) Int. Cl.
*C23C 18/24* (2006.01)
*C23C 18/28* (2006.01)
(Continued)

(52) U.S. Cl.
CPC ..... *C23C 18/1625* (2013.01); *C23C 18/2073* (2013.01); *C23C 18/24* (2013.01);
(Continued)

(58) Field of Classification Search
CPC . C23C 18/1653; C23C 18/2086; C23C 28/00; C23C 18/24; C23C 18/28;
(Continued)

(56) References Cited

U.S. PATENT DOCUMENTS 3,443,988 A 5/1969 McCormack et al.
3,930,963 A 1/1976 Polichette et al.
(Continued)

FOREIGN PATENT DOCUMENTS

CN 1329557 C 8/2007
CN 102409320 A 4/2012
(Continued)

OTHER PUBLICATIONS

Gezernnan et al., "2-Mercaptobenzinnidazole, 2-Mercaptobenzothiazole, and Thioglycolic Acid in an Electroless Nickel-Plating Bath," Journal of Chemistry, vol. 2015, Article ID 872516, pp. 1-11. (Year: 2015).*

(Continued)

*Primary Examiner* — Edna Wong
(74) *Attorney, Agent, or Firm* — Leydig, Voit & Mayer, Ltd.

(57) ABSTRACT

The invention refers to a process for metallization of an article having a plastic surface avoiding the metallization of the rack which fixes the article within the plating bath.

18 Claims, 6 Drawing Sheets

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Material treated | ABS Novodur P2MC | | | | | ABS/PC BAYBLEND T45 | | | | |
| Cleaning solution | X | X | X | X | X | | | | | |
| Swelling solution | | | | | | X | X | X | X | X |
| Rack Conditioning | | | | | X | | | | | X |
| Etching | X | X | X | X | X | X | X | X | X | X |
| Reduction | X | | X | X | X | X | | X | X | X |
| Reduction/Rack Conditioning | X | X | | | | X | X | | | |
| Rack Conditioning | | | X | | | | | X | | |
| Conditioner | X | X | X | X | X | X | X | X | X | X |
| Catalyst | X | X | X | X | X | X | X | X | X | X |
| Accelerator | X | X | X | X | X | X | X | X | X | X |
| Electroless deposition | X | X | X | X | X | X | X | X | X | X |
| Electrolytic deposition | X | X | X | X | X | X | X | X | X | X |
| Parts Metallization | 100% | 100% | 100% | 100% | 100% | 100% | 100% | 100% | 100% | 100% |
| PVC rack metallization | 0% | 0% | 0% | 100% | 100% | 0% | 0% | 0% | 100% | 100% |
| Metal adhesion on plastic parts to be metallized | OK | OK | OK | OK | OK | OK | OK | OK | OK | OK |

(51) Int. Cl.

| | |
|---|---|
| ***C23C 18/30*** | (2006.01) |
| ***C23C 28/02*** | (2006.01) |
| ***C23C 18/16*** | (2006.01) |
| ***C23C 18/20*** | (2006.01) |
| ***C25D 5/56*** | (2006.01) |
| ***C25D 17/08*** | (2006.01) |

(52) U.S. Cl.
CPC ..... *C23C 18/30* (2013.01); *C23C 28/02* (2013.01); *C25D 5/56* (2013.01); *C25D 17/08* (2013.01)

(58) Field of Classification Search
CPC ..... C23C 18/30; C23C 28/02; C23C 28/023; B05D 3/00
USPC ..... 205/164, 167, 210; 427/299, 304, 307, 427/322
See application file for complete search history.

(56) References Cited

U.S. PATENT DOCUMENTS

| | | | | |
|---|---|---|---|---|
| 4,610,895 | A | 9/1986 | Tubergen et al. | |
| 7,025,867 | B2 | 4/2006 | Czeczka et al. | |
| 2004/0112755 | A1 | 6/2004 | Czeczka et al. | |
| 2010/0120962 | A1* | 5/2010 | Yoshida | C23C 18/54 524/428 |
| 2010/0155255 | A1* | 6/2010 | Nagao | C23C 18/1653 205/184 |
| 2015/0001177 | A1* | 1/2015 | Middeke | C23C 18/1603 216/37 |
| 2015/0307992 | A1 | 10/2015 | Naruskevicius et al. | |
| 2016/0258066 | A1* | 9/2016 | Hiei | C23C 18/1619 |

FOREIGN PATENT DOCUMENTS

| | | | | | |
|---|---|---|---|---|---|
| CN | 104005028 | A | | 8/2014 | |
| CN | 104499019 | A | | 4/2015 | |
| EP | 3 168 326 | A1 | | 5/2017 | |
| EP | 3 216 756 | | | 9/2017 | |
| JP | 60-77994 | A | | 5/1985 | |
| JP | 2006-316350 | A | | 11/2006 | |
| JP | 2006316350 | A | * | 11/2006 | C23C 18/18 |
| WO | WO 2013/135862 | A2 | | 9/2013 | |
| WO | WO 2015/126544 | A1 | | 8/2015 | |
| WO | WO 2016/006301 | A1 | | 1/2016 | |
| WO | WO 2016/022535 | A1 | | 2/2016 | |

OTHER PUBLICATIONS

European Patent Office, International Search Report in International Application No. PCT/EP2017/057766 (dated May 12, 2017).
European Patent Office, Written Opinion in International Application No. PCT/EP2017/057766 (dated May 12, 2017).
International Bureau of WIPO, International Preliminary Report on Patentability in International Application No. PCT/EP2017/057766 (dated Oct. 9, 2018).
European Patent Office, Communication pursuant to Article 94(3) EPC in European Patent Application No. 17 714 784.0 (dated Jul. 19, 2019).
European Patent Office, Communication pursuant to Article 94(3) EPC in European Patent Application No. 17 714 784.0 (dated Dec. 11, 2019).
State Intellectual Property Office of the People'S Republic of China, First Office Action and Search Report in Chinese Patent Application No. 201780022493.0 (dated May 22, 2020).

* cited by examiner

Figure 1

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Material treated | ABS Novodur P2MC | | | | | ABS/PC BAYBLEND T45 | | | | |
| Cleaning solution | X | X | X | X | X | | | | | |
| Swelling solution | | | | | | X | X | X | X | X |
| Rack Conditioning | | | | | X | | | | | X |
| Etching | X | X | X | X | X | X | X | X | X | X |
| Reduction | X | | X | X | X | X | | X | X | X |
| Reduction/Rack Conditioning | X | X | | | | X | X | | | |
| Rack Conditioning | | | X | | | | | X | | |
| Conditioner | X | X | X | X | X | X | X | X | X | X |
| Catalyst | X | X | X | X | X | X | X | X | X | X |
| Accelerator | X | X | X | X | X | X | X | X | X | X |
| Electroless deposition | X | X | X | X | X | X | X | X | X | X |
| Electrolytic deposition | X | X | X | X | X | X | X | X | X | X |
| Parts Metallization | 100% | 100% | 100% | 100% | 100% | 100% | 100% | 100% | 100% | 100% |
| PVC rack metallization | 0% | 0% | 0% | 100% | 100% | 0% | 0% | 0% | 100% | 100% |
| Metal adhesion on plastic parts to be metallized | OK | OK | OK | OK | OK | OK | OK | OK | OK | OK |

Figure 2

| | **Example 11 With rack conditioning step** | | **Example 12 Without rack conditioning step** | | **Example 13 With rack conditioning step** | | **Example 14 Without rack conditioning step** | |
|---|---|---|---|---|---|---|---|---|
| Material treated | Bi-component (specially used in automotive market) | | | | Bi-component (specially used in perfume taps market) | | | |
| | ABS | PC | ABS | PC | ABS | PCTA | ABS | PCTA |
| Cleaning | X | | X | | X | | X | |
| Etching | X | | X | | X | | X | |
| Reduction | X | | X | | X | | X | |
| Reduction/Rack Conditioning | X | | | | X | | | |
| Conditioner | X | | X | | X | | X | |
| Catalyst | X | | X | | X | | X | |
| Accelerator | X | | X | | X | | X | |
| Electroless deposition | X | | X | | X | | X | |
| Electrolytic sequence | X | | X | | X | | X | |
| Parts Metallization | 100% | 0% | 100% | 100% | 100% | 0% | 100% | 100% |
| PVC rack metallization | 0% | | 100% | | 0% | | 100% | |
| Metal adhesion on plastic parts to be metallized | OK | | OK | | OK | | OK | |

Figure 3

| | | Example 15 Without rack conditioning step | | Example 16 With rack conditioning step without thickening agent | | Example 17 With rack conditioning step with thickening agent | |
|---|---|---|---|---|---|---|---|
| | | ABS | PVC | ABS | PVC | ABS | PVC |
| Cleaning | | X | | X | | X | |
| Etching | | X | | X | | X | |
| Reduction | | X* | | X | | X | |
| Reduction/Rack Conditioning | | | | 5.5 g/L Hydroxylamine sulfate, 0.2mol/L hydrochloric acid, 0.15g/L 2-mercapto-benzothiazole, 3 min at 55°C* | | 5.5 g/L Hydroxylamine sulfate, 0.2mol/L hydrochloric acid, 0.5g/L carboxymethylcellulose, 0.15g/L 2-mercapto-benzothiazole, 3 min at 55°C* | |
| Conditioner | | X | | X | | X | |
| Catalyst | | X | | X | | X | |
| Accelerator | | X | | X | | X | |
| Electroless deposition | | X | | X | | X | |
| Electrolytic sequence | | X | | X | | X | |
| ABS Parts/PVC rack Metallization | | 100% | 100% | 100% | 20% | 100% | 0% |
| Metal adhesion on ABS plastic parts to be metallized | | OK | | OK | | OK | |
| EDX Analysis % Mass made immediately after the rinsing step situated * | Carbon | 79.34 | 65.98 | 79.66 | 65.51 | 79.00 | 61.60 |
| | Nitrogen | 13.02 | 1.85 | 12.82 | 1.61 | 12.94 | 3.04 |
| | Oxygen | 7.57 | 11.83 | 7.43 | 11.64 | 7.96 | 11.65 |
| | **Sulfur** | **0.07** | **0.08** | **0.09** | **0.15** | **0.11** | **6.27** |
| | Chlorine + Rest of element traces | 0.00 | 20.26 | 0.00 | 21.08 | 0.00 | 17.44 |

Figure 4 (Example 15 SEM Images made on ABS and PVC surface immediately after rinse of the reduction step)
ABS surface
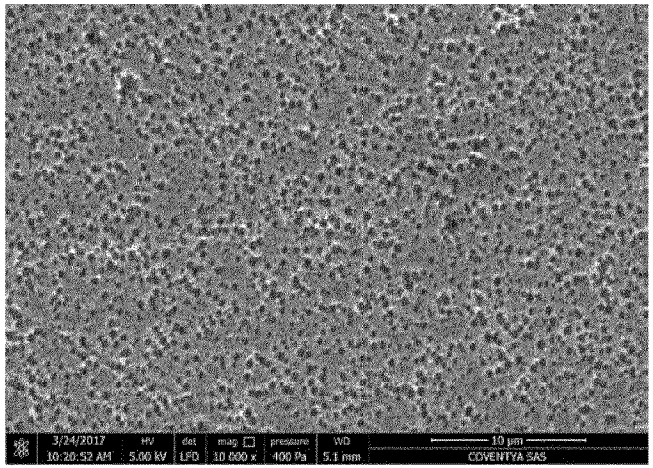
10.000X magnification
PVC Surface
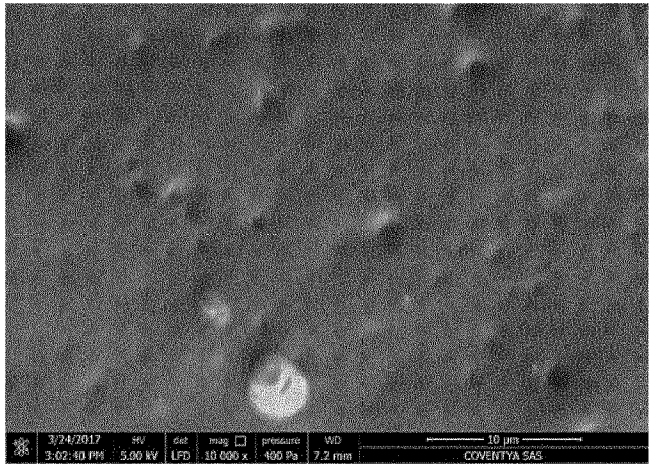
10.000X magnification
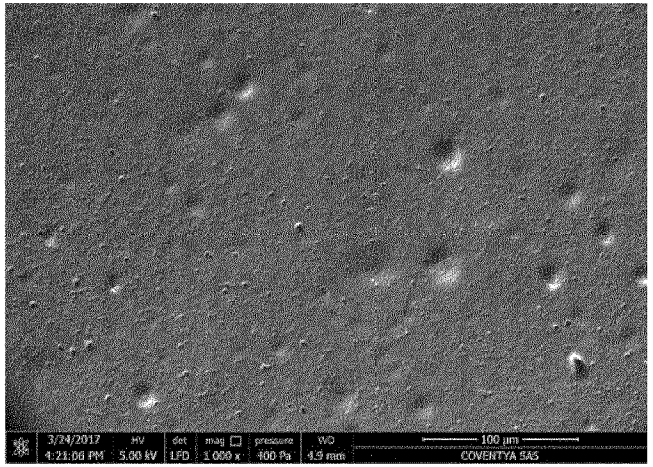
1.000X magnification

Figure 5 (Example 16 SEM Images made on ABS and PVC surface immediately after rinse of the reduction/rack conditioning step)
ABS surface
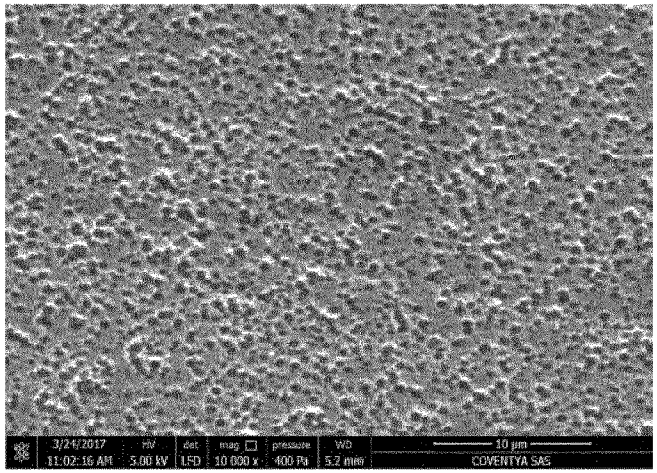
10.000X magnification
PVC Surface
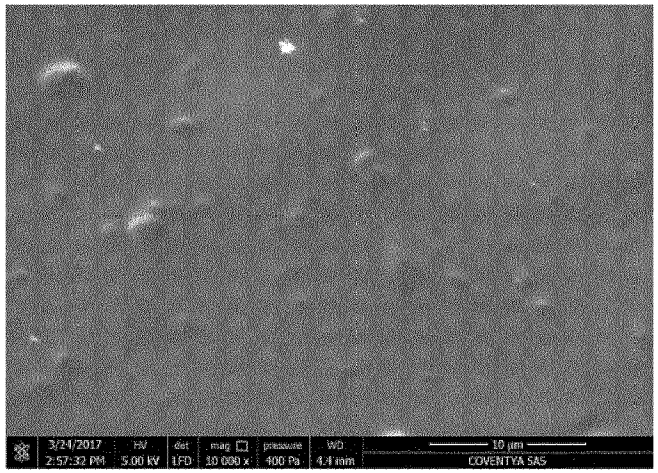
10.000X magnification
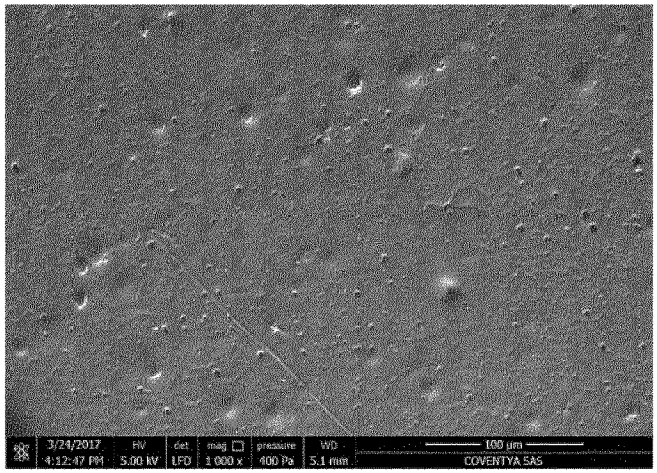
1.000X magnification

Figure 6 (Example 17 SEM Images made on ABS and PVC surface immediately after rinse of the reduction/rack conditioning step)
ABS surface
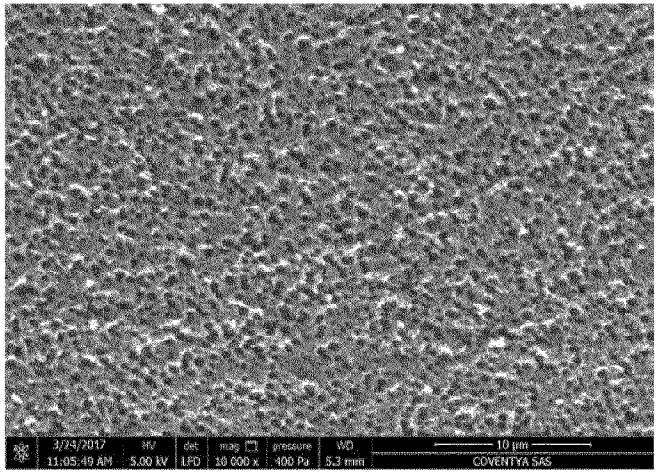
10.000X magnification
PVC Surface
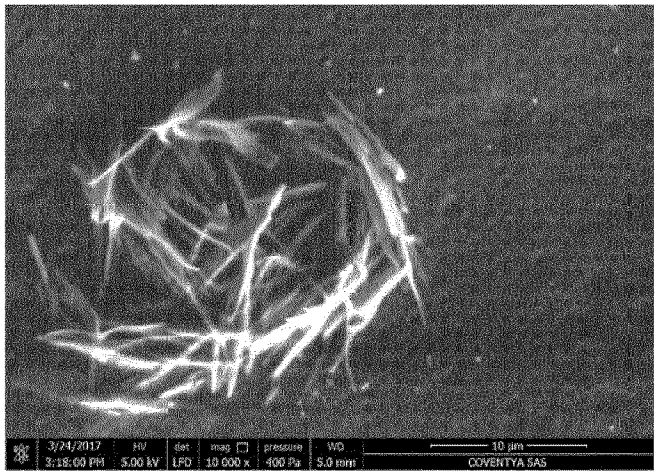
10.000X magnification
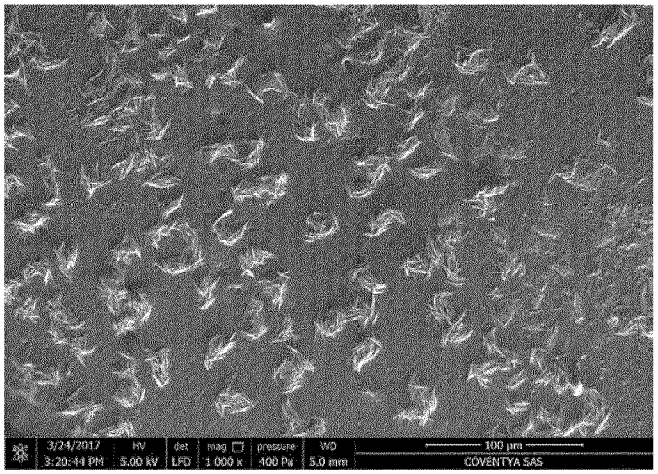
1.000X magnification

PROCESS FOR METALLIZATION OF AN ARTICLE HAVING A PLASTIC SURFACE AVOIDING THE METALLIZATION OF THE RACK WHICH FIXES THE ARTICLE WITHIN THE PLATING BATH

CROSS-REFERENCE TO RELATED APPLICATIONS

This patent application is the U.S. national phase of International Application No. PCT/EP2017/057766, filed on Mar. 31, 2017, which claims the benefit of European Patent Application No. 16163748.3, filed Apr. 4, 2016, the disclosures of which are incorporated herein by reference in their entireties for all purposes.

The invention refers to a process for metallization of an article having a plastic surface avoiding the metallization of the rack which fixes the article within the plating bath.

The process comprises an etching step with an etching solution being free of hexavalent chromium, a treatment of the plastic surface with a reducing agent and a metallization step. Furthermore, the process comprises a treatment of the plastic surface with an aqueous rack conditioning solution.

Contacting the plastic surface with the rack conditioning solution provides selective protection of the rack from metallization whereas the article with the plastic surface is selectively metalized.

In general, the preparation of plastic articles for metal (e.g. nickel) deposition requires an etching of the plastic article. It is known that such etching may be performed with a solution containing hexavalent chromium and sulphuric acid. However, hexavalent chromium is highly toxic for humans and the environment. Since it is considered to be carcinogenic, mutagen and reprotoxic and is present in the list of substances submitted to authorization in the REACH directive, there is a large interest in the field to abolish the use of etching solutions which are based on hexavalent chromium.

As an alternative to hexavalent chromium, etching solutions comprising potassium permanganate are known. However, said $Cr^{6+}$-free etching solutions suffer the drawback that they are less capable of preventing metallization of the rack having a plastic surface— usually a plastic surface of polyvinyl chloride ("PVC")— which fixes the article with the surface to be metallized (usually a surface comprising or consisting of ABS) in place during electroless and/or electrolytic deposition. Metallisation of the fixing rack is not desired because it unnecessarily depletes the electrolyte of metal, pollutes the electrolytic bath, creates problems regarding the operating plating parameters management and consequently creates a problem regarding the thickness of metal on the finished metallized articles. Moreover, it finally obliges to remove the metallic deposits (e.g. copper, nickel, chromium) from the rack surface which is costly and takes time.

In the prior art, several processes are known to prevent metallisation of the plastic surface of the rack during electroless deposition.

WO 2015/126544 A1 discloses a process for preventing rack metallisation, wherein the rack is treated with a non-aqueous solution comprising a metallisation inhibitor. In said process, the plastic coated rack is immersed in said non-aqueous solution before the etching step (e.g. with permanganate) takes place. As metallisation inhibitor, an organic sulphur compound is used at a very high concentration of 5 to 40 g/L. The drawback of said process is the use of a relatively high concentration of metallisation inhibitor which is responsible for a drag-out of metallization inhibitor and a "pollution" of the solutions used in successive steps. Finally, WO 2015/126544 A1 teaches the use of a non-aqueous solution which is unecological. In addition, it has been found that the use of non-aqueous solvents is prone to deteriorate the plastic surface of the rack (usually comprising or consisting of PVC) making the process inefficient on an economical point of view.

WO 2016/022535 A1 discloses a method of coating an electroplating rack used for supporting non-conductive substrates during a plating process. The method comprises the steps of contacting at least a portion of the electroplating rack with a plastisol composition, the plastisol composition having dispersed therein an effective amount of an additive that is a sulphur derivative with the structure reported in the description.

This method shows several drawbacks, first of all it is economically unfavourable as it requires to produce new PVC plastisols containing the inhibitor. Secondly, the incorporation of the inhibitor in the plastisol will not necessarily conduct to the presence of the inhibitor at the surface of the plastisol and consequently is not as efficient in preventing rack metallisation compared to the present invention. In addition, the incorporation of such high amounts of inhibitors (5 to 15% by weight) in the plastisol will lead to a high risk of release of the inhibitor in the plating line especially when the racks will age and consequently will contaminate the line and makes the process non effective.

WO 2013/135862 A2 discloses a process for preventing rack metallisation, wherein the rack is treated with an aqueous solution comprising a metallisation inhibitor. In said process, the plastic rack is contacted with the aqueous solution either before or after the etching step (e.g. with permanganate) takes place. As metallisation inhibitor, metal iodate is used at a very high concentration of 5 to 50 g/L. The drawback of said process is that a very high concentration of metallization inhibitor is used which creates a problem of "pollution" of the solutions used in the successive steps of the process (e.g. a pollution of the catalyst solution, accelerator solution and electroless bath in general). Thus, the long-term stability of the process is low. Moreover, a high concentration of inhibitor and permanganate ions (30 to 250 g/L) is needed to obtain the desired effect which is uneconomical.

Starting therefrom, it was the object to provide a more long-term stable, more economical and more ecological process for selective metallization of an article having a plastic surface without metallization of the plastic rack which fixes the article.

The problem is solved by the process described herein. Also described are preferred embodiments of the invention.

According to the invention, a process is provided for metallization of an article having a plastic surface comprising the steps a) fastening the article to a rack;

b) etching the plastic surface with an aqueous etching solution free of $Cr^{6+}$;

c) treating the plastic surface with a reducing agent; and d) metallizing the plastic surface;

wherein, after step c) or during step c), the plastic surface of the article and the rack are treated with an aqueous acidic rack conditioning solution which comprises water, at least one organosulfur compound and at least one inorganic acid, at temperatures from 25 to 70° C.

The term "plastic surface" refers to the plastic surface of the article. If the rack has a plastic surface, the term "plastic surface" refers to the plastic surface of the rack as well.

The inventive process has the advantage that a rack conditioning solution is used which is aqueous and acidic. The benefit of the solution being aqueous is that it is more environmentally friendly compared to non-aqueous (organic solvent based) solutions. The advantage of the solution being acidic is that it is compatible with the reducing agent addition. This allows reducing the number of process steps and no (additional) reduction step has necessarily to be performed after the etching step and before the rack conditioning step. It has furthermore been discovered that implementing the etching step before the rack conditioning step is beneficial compared to implementing the etching step afterwards (like in some prior art processes). It has been found that performing the etching step after the rack conditioning step at least partly removes the beneficial effect of the rack conditioning step, probably by washing away and oxidizing the organosulfur compound bound to the surface of the plastic rack.

The organosulfur compound may be an organosulfur compound containing bivalent sulphur. According to the invention, an "organosulfur compound containing bivalent sulfur" is an organosulfur compound represented by the formula R—SH, R"—S—R", wherein R, R' and R" represent an organic group (i.e. a carbon-containing group) and R' and R" may be the same or may be different. Preferably, the organosulfur compound is an organosulfur compound represented by the formula R—SH, wherein R represents an organic group, i.e. the organosulfur compound is an organic compound comprising a thiol residue. Particularly preferred, the organosulfur compound is selected from the group consisting of dithiocarbamates, 2-mercaptobenzimidazole, 2-mercaptobenzothiazole, 3-mercaptopropansulfonic acid sodium salt, thioglycolic acid, 3-(benzothiazolyl-2-mercapto)propyl sulfonic acid sodium salt, and mixtures thereof. More preferably, the organosulfur compound is 2-mercaptobenzothiazole.

The organosulfur compound used in the inventive process may have a concentration of 0.001 to 2 g/L, preferably 0.01 to 1 g/L, more preferably 0.05 to 0.2 g/L, most preferably 0.1 g/L, in the solution.

It is preferred that at least one inorganic acid in the rack conditioning solution is preferably selected from the group consisting of hydrochloric acid, sulphuric acid, phosphoric acid, and mixtures thereof, most preferably hydrochloric acid wherein the concentration of the inorganic acid in the rack conditioning solution is from 0.01 to 2 mol/L, preferably 0.05 to 1.5 mol/L, more preferably 0.08 to 0.6 mol/L.

The treatment with the reducing agent, i. e. step c) of the process, can be a separate step by treating the etched plastic rack with an aqueous reducing solution. Optionally, the reducing agent can be added to the rack conditioning solution which results in a simultaneous treatment with the reducing agent and the conditioning solution. It is also possible to use both options together.

The reducing agent is preferably suitable to chemically reduce manganese compounds, e.g. manganese compounds coming from the drag out of the treatment with etching solution and from remaining etching residues present on the plastic surface. Suitable reducing compounds include compounds having a hydroxylamine group, ascorbic acid, hydrazine, thiosulfate salts, and mixtures thereof. Preferably, the compound comprising a hydroxylamine group is hydroxylamine sulphate. The reducing agent may have a concentration of 1 to 100 g/L, preferably 10 to 40 g/L, more preferably 20 g/L, in the solution.

In a preferred embodiment of the invention, the aqueous acidic rack conditioning solution comprises at least one thickening agent, preferably selected from the group consisting of polyvinyl alcohol, PEG, sodium alginate, polysaccharides, agarose, carboxymethylcellulose, and mixtures thereof, more preferably carboxymethylcellulose; wherein the concentration of the at least one thickening agent in the rack conditioning solution is from 0.001 to 10 g/L, preferably 0.01 to 1 g/L, more preferably 0.05 to 0.2 g/L, most preferably 0.1 g/L. It has been observed that having a thickening agent in the aqueous acidic rack conditioning solution provokes that during the treatment with the aqueous acidic rack conditioning solution, the organosulfur compound is better adsorbed to the plastic surface of the rack, especially better adsorbed into holes located on the plastic surface of the rack. In essence, the thickening agent provides a more thorough adsorption of a larger quantity of organosulfur compound to the plastic surface of the rack and thus leads to an improved prevention of rack metallization.

It is further preferred that the aqueous rack conditioning solution has a temperature of 25 to 70° C., preferably 45 to 60° C., most preferably 45 to 55° C.; and/or the plastic surface is treated with the aqueous rack conditioning solution for 0.1 to 15 min, preferably 0.5 to 10 min, most preferably 1 to 5 min.

In the preferred embodiment the plastic surface of the article at least partially comprises or consists of a plastic selected from the group consisting of acrylonitrile-butadiene-styrene, acrylonitrile-butadiene-styrene-blends, polypropylene and mixtures thereof, preferably acrylonitrile-butadiene-styrene, acrylonitrile-butadiene-styrene-polycarbonate blends and mixtures thereof.

Preferably, the rack does not comprise a plastic surface like the plastic surface of the article, wherein the rack is preferably a) free of a plastic selected from the group consisting of acrylonitrile-butadiene-styrene, acrylonitrile-butadiene-styrene blends, polypropylene and mixtures thereof, preferably free of a plastic selected from the group consisting of acrylonitrile-butadiene-styrene, acrylonitrile-butadiene-styrene-polycarbonate blends and mixtures thereof; and/or b) at least partially comprises or consists of a plastic selected from the group consisting of polyvinyl chloride.

Naturally, the rack may comprise additives, plasticizers, dyes and/or fillers.

It is preferred that before step b), the plastic surface is cleaned with a cleaning solution, which preferably comprises at least one wetting agent for cleaning and/or a solvent for swelling, wherein the cleaning solution preferably has a temperature of 30 to 70° C., preferably 40 to 60° C., more preferably 45 to 55° C. and the plastic surface is preferably treated with the cleaning solution for 1 to 10 min, preferably 2 to 8 min, most preferably 4 to 6 min.

It is preferred that the etching solution comprises $KMnO_4$ and phosphoric acid, wherein the etching solution has preferably a temperature of 50 to 80° C., preferably 60 to 70° C., more preferably 65 to 70° C. and the plastic surface is treated with the etching solution for 2 to 20 min, preferably 4 to 18 min, most preferably 8 to 15 min. Preferably an oxidizing agent as a stabilizer can be added for stabilizing $Mn^{VII}$ in the etching solution.

It is preferred that the aqueous acidic reducing solution comprises at least one inorganic acid and a reducing agent. The inorganic acid is preferably selected from the group consisting of hydrochloric acid, sulphuric acid, phosphoric acid, and mixtures thereof, most preferably hydrochloric acid, wherein the concentration of the at least one inorganic acid is from 0.5 to 2.5 mol/L, most preferably 1 to 2 mol/L.

The reducing agent includes compounds having a hydroxylamine group, ascorbic acid, hydrazine, thiosulfate salts, and mixtures thereof. Preferably, the compound comprising a hydroxylamine group is hydroxylamine sulphate. The reducing agent may have a concentration of 1 to 100 g/L, preferably 10 to 40 g/L, more preferably 20 g/L, in the solution. It is further preferred that the aqueous reducing solution has a temperature of 45 to 70° C., preferably 45 to 60° C., most preferably 45 to 55° C.; and the plastic surface is treated with the aqueous reducing solution for 0.1 to 15 min, preferably 0.5 to 10 min, most preferably 1 to 5 min.

After any one or all of steps a) to d) and the treatment step with the rack conditioning solution of the inventive method, the plastic surface may be rinsed, preferably rinsed with water.

In a preferred embodiment of the invention, metalizing the plastic surface comprises at least one, preferably all, of the steps of (i) treating the plastic surface with an aqueous acidic catalyst solution, wherein the aqueous acidic catalyst solution preferably comprises colloidal palladium, more preferably further comprises HCl;

(ii) treating the plastic surface with an aqueous acidic accelerator solution, wherein the aqueous acidic accelerator solution preferably comprises $H_2SO_4$;

(iii) treating the plastic surface with an aqueous alkaline solution for electroless deposition of a metal, wherein the solution for electroless deposition of a metal preferably comprises nickel ions, more preferably further comprises ammonia, most preferably further comprises hypophosphite; and (iv) electrolytically depositing a metal on the surface having electroless-deposited metal, wherein the metal is preferably selected from the group consisting of copper, nickel, chromium and alloys thereof.

BRIEF DESCRIPTION OF THE SEVERAL VIEWS OF THE DRAWING(S)

FIG. 1 depicts the results of Examples 1-10.

FIG. 2 depicts the results of Examples 11-14.

FIG. 3 depicts the results of Examples 15-17.

FIG. 4 depicts the SEM pictures obtained on the ABS and PVC surfaces immediately after rinse of the reduction step (Example 15).

FIG. 5 depicts the SEM pictures obtained on the ABS and PVC surfaces immediately after rinse of the reduction/rack conditioning step (Example 16).

FIG. 6 depicts the SEM pictures obtained on the ABS and PVC surfaces immediately after rinse of the reduction/rack conditioning step (Example 17).

DETAILED DESCRIPTION OF THE INVENTION

With reference to the following examples, the subject-matter according to the invention is intended to be explained in more detail without wishing to restrict said subject-matter to the specific embodiments shown here.

The Solutions Used in the Successive Examples have the Following Composition:

Cleaning: SILKEN CLEANER 201 (Coventya), 40 mL/L in water, 3 min at 45° C.;

Swelling: SILKEN CLEANER 202 (Coventya), 140 mL/L in water, 3 min at 45° C.;

Rack conditioning: 0.1 mol/L phosphoric acid, 0.1 g/L carboxymethyl-cellulose, 0.2 g/L 2-mercaptobenzothiazole, 3 min at 45° C.;

Etching: SILKEN BOND ETCH PART A (Coventya) 12 mL/L (0.3 g/L $KMnO_4$), $H_3PO_4$ 620 mL/L, SILKEN BOND ETCH PART C (Coventya) (STABILIZER) 340 mL/L, 12 min at 65° C.;

Reduction: 12 g/L hydroxylamine sulfate, 1.2 mol/L hydrochloric acid, 3 min at 55° C.;

Reduction/Rack Conditioning: 6 g/L Hydroxylamine sulfate, 0.2 mol/L hydrochloric acid, 0.1 g/L carboxymethylcellulose, 0.2 g/L 2-mercapto-benzothiazole, 3 min at 55° C.;

Conditioner: SILKEN BOND CONDITIONER (Coventya) 10 mL/L, 1 min 25° C.;

Catalyst: SILKEN CATALYST 501 (Coventya) 10 mL/L (40 ppm colloidal Pd), 250 mL/L HCl 32%, 3 min 30° C.;

Accelerator: SILKEN ACCELERATOR (Coventya) 601 50 g/L, 25 mL/L sulfuric acid 96%, 2 min 40° C.;

Electroless dep.: Electroless Nickel as process SILKEN METAL 706 (Coventya) with ammonia (Ni 3 g/L hypophosphite 18 g/L), 10 min at 28° C.;

Electrolytic dep.: Cu/Ni/Cr deposition solution.

The sequence of use of said compositions is shown in FIGS. 1, 2 and 3. Rinses steps in water are always present between each steps. An "X" indicates that a treatment with the indicated solution has been performed whereas a blank box indicates that no treatment with the indicated solution has been performed.

Example 1—Treatment of an article with ABS surface and a rack with PVC surface with a Sequence comprising a reducing step followed by a mix reducing/rack conditioning step The articles having a surface comprising or consisting of ABS are panels molded in ABS Novodur P2MC. The racks used for fixing the articles to be metalized have a PVC surface.

The result of the experiment is shown in FIG. 1. In fact, the metallization of the article with the ABS surface was 100% whereas the metallization of the rack with the PVC surface (fixing the article with the ABS surface in each solution) was 0% regardless.

Example 2—Treatment of an Article with ABS Surface and a Rack with PVC Surface with a Sequence Comprising Only a Mix Reducing/Rack Conditioning Step The articles having a surface comprising or consisting of ABS are panels molded in ABS Novodur P2MC. The racks used for fixing the articles to be metalized have a PVC surface.

The result of the experiment is shown in FIG. 1. In fact, the metallization of the article with the ABS surface was 100% whereas the metallization of the rack with the PVC surface (fixing the article with the ABS surface in each solution) was 0%.

Example 3—Treatment of an Article with ABS Surface and a Rack with PVC Surface with a Sequence Comprising Separately a Reducing Step and a Rack Conditioning Step The articles having a surface comprising or consisting of ABS are panels molded in ABS Novodur P2MC. The racks used for fixing the articles to be metalized have a PVC surface.

The result of the experiment is shown in FIG. 1. In fact, the metallization of the article with the ABS surface was 100% whereas the metallization of the rack with the PVC surface (fixing the article with the ABS surface in each solution) was 0%.

In all these examples (1, 2 and 3), whether the reduction solution and rack conditioning solution were used separately or a combined reduction/rack conditioning solution was used, the PVC metallization is prevented.

Example 4—Treatment of an Article with ABS Surface and a Rack with PVC Surface with a Sequence without Rack Conditioning Step The articles having a surface comprising or consisting of ABS are panels molded in ABS Novodur P2MC. The racks used for fixing the articles to be metalized have a PVC surface.

The result of the experiment is shown in FIG. 1. In fact, the metallization of the article with ABS surface was 100% and also the metallization of the rack with PVC surface (fixing the article with the ABS surface in each solution) was 100%.

Example 5—Treatment of an Article with ABS Surface and a Rack with PVC Surface with a Sequence where the Rack Conditioning Step is Before the Etching Step The articles having a surface comprising or consisting of ABS are panels molded in ABS Novodur P2MC. The racks used for fixing the articles to be metalized have a PVC surface.

The result of the experiment is shown in FIG. 1. In fact, the metallization of the article with ABS surface was 100% and also the metallization of the rack with PVC surface (fixing the article with the ABS surface in each solution) was 100%.

The results of the examples 4 and 5 allow the conclusion that the treatment of the articles with ABS surface with the rack conditioning solution does not prevent metallization of their ABS surface whereas the metallization of the PVC surface of the racks is effectively prevented. However, prevention of the PVC surface metallization is only observed if the treatment with the rack conditioning solution is performed after the etching step and not if it is performed before the etching step.

Example 6—Treatment of an Article with ABS/PC Surface and a Rack with PVC Surface with a Sequence Comprising a Reducing Step Followed by a Mix Reducing/Rack Conditioning Step The articles having a surface comprising or consisting of ABS/PC are panels molded in ABS/PC BAYBLEND T45. The racks used for fixing the articles to be metalized have a PVC surface.

The result of the experiment is shown in FIG. 1. In fact, the metallization of the article with ABS/PC surface was 100% whereas the metallization of the PVC surface of the rack (fixing the article with the ABS/PC surface in each solution) was 0%.

Example 7—Treatment of an Article with ABS/PC Surface and a Rack with PVC Surface with a Sequence Comprising Only a Mix Reducing/Rack Conditioning Step The articles having a surface comprising or consisting of ABS/PC are panels molded in ABS/PC BAYBLEND T45. The racks used for fixing the articles to be metalized have a PVC surface.

The result of the experiment is shown in FIG. 1. In fact, the metallization of the article with the ABS/PC surface was 100% whereas the metallization of the rack with the PVC surface (fixing the article with the ABS/PC surface in each solution) was 0% regardless.

Example 8—Treatment of an Article with ABS/PC Surface and a Rack with PVC Surface with a Sequence Comprising Separately a Reducing Step and a Rack Conditioning Step The articles having a surface comprising or consisting of ABS/PC are panels molded in ABS/PC BAYBLEND T45. The racks used for fixing the articles to be metalized have a PVC surface.

The result of the experiment is shown in FIG. 1. In fact, the metallization of the article with the ABS/PC surface was 100% whereas the metallization of the rack with the PVC surface (fixing the article with the ABS/PC surface in each solution) was 0%.

In the examples 6, 7 and 8, whether the reduction solution and rack conditioning solution were used separately or a combined reduction/rack conditioning solution was used, the PVC metallization is prevented.

Example 9—Treatment of an Article with ABS/PC Surface and a Rack with PVC Surface with a Sequence without Rack Conditioning Step The articles having a surface comprising or consisting of ABS/PC are panels molded in ABS/PC BAYBLEND T45. The racks used for fixing the articles to be metalized have a PVC surface.

The result of the experiment is shown in FIG. 1. In fact, the metallization of the plastic article with ABS/PC surface was 100% and also the metallization of the rack with PVC surface (fixing the article with the ABS/PC surface in each solution) was 100%.

Example 10—Treatment of an Article with ABS/PC Surface and a Rack with PVC Surface with a Sequence where the Rack Conditioning Step is Before the Etching Step The articles having a surface comprising or consisting of ABS/PC are panels molded in ABS/PC BAYBLEND T45. The racks used for fixing the articles to be metalized have a PVC surface.

The result of the experiment is shown in FIG. 1. In fact, the metallization of the article with ABS/PC surface was 100% and also the metallization of the rack with PVC surface (fixing the article with the ABS/PC surface in each solution) was 100%.

The results of the example 9 and 10 allow the conclusion that the treatment of the articles with ABS/PC surface with the rack conditioning solution does not prevent metallization of their ABS/PC surface whereas the metallization of the PVC surface of the racks is effectively prevented. Again, prevention of rack metallization is only observed if the treatment with the rack conditioning solution is performed after the etching step and not if it is performed before the etching step.

Example 11—Treatment of Article with an ABS and PC Surface (Bi-Component Articles) and a Rack with PVC Surface The article to be metalized has two different plastic surfaces i.e. is a bi-component plastic article comprising ABS on one part of its surface and PC on another part of its surface (ABS-PC bi-component). Said article is specifically common in the automotive market. The racks used for fixing the article to be metalized have a PVC surface.

The result of the experiment is shown in FIG. 2. In fact, the metallization of the ABS-PC bi-component article was 100% at the ABS surface and 0% at the PC surface. The metallization of the PVC surface of the rack (fixing the bi-component articles in each solution) was 0%.

Example 12—Treatment of Article with an ABS and PC Surface (Bi-Component Articles) and a Rack with PVC Surface without Rack Conditioning Step The article to be metalized has two different plastic surfaces i.e. is a bi-component plastic article comprising ABS on one part of its surface and PC on another part of its surface (ABS-PC bi-component). Said article is specifically common in the automotive market. The racks used for fixing the article to be metalized have a PVC surface.

The result of the experiment is shown in FIG. 2. In fact, the metallization of the ABS surface of the bi-component article was 100% and also the metallization of the PC surface of the bi-component article was 100%. The metallization of the PVC surface of the rack (fixing the bi-component articles in each solution) was 100% as well.

The results of the examples 11 and 12 allow the conclusion that the treatment of the bi-component article with the rack conditioning solution does not prevent metallization of the ABS surface of the bi-component article whereas the metallization of the PC surface of the bi-component article is effectively prevented (=selective metallization of ABS surface compared to PC surface). In addition, the metallization of the PVC surface of the rack is effectively prevented (=selective metallization of ABS surface compared to PVC surface). This allows the conclusion that the treatment of article with the rack conditioning solution after the etching step provokes a very selective metallization of surfaces comprising or consisting of ABS compared to other types of plastic surfaces (e.g. PC and PVC surfaces).

Example 13—Treatment of an Article with an ABS and PCTA Surface (Bi-Component Articles) and a Rack with PVC Surface The article to be metalized has two different plastic surfaces i.e. is a bi-component plastic article comprising ABS on one part of its surface and PCTA on another part on its surface (ABS-PCTA bi-component). Said article is specifically common in the perfume taps market. The racks used for fixing the article to be metalized have a PVC surface.

The result of the experiment is shown in FIG. 2. In fact, the metallization of the ABS-PCTA bi-component article was 100% at the ABS surface and 0% at the PCTA surface. The metallization of the PVC surface of the rack (fixing the bi-component article in each solution) was 0%.

Example 14—Treatment of an Article with an ABS and PCTA Surface (Bi-Component Articles) and a Rack with PVC Surface without Rack Conditioning Step The article to be metalized has two different plastic surfaces i.e. is a bi-component plastic article comprising ABS on one part of its surface and PCTA on another part on its surface (ABS-PCTA bi-component). Said article is specifically common in the perfume taps market. The racks used for fixing the article to be metalized have a PVC surface.

The result of the experiment is shown in FIG. 2. In fact, the metallization of the ABS surface of the bi-component plastic article was 100% and also the metallization of the PCTA surface of the bi-component plastic article was 100%. The metallization of the PVC surface of the rack (fixing the bi-component articles in each solution) was 100% as well.

The results of the examples 13 and 14 allow the conclusion that the treatment of the bi-component article with the rack conditioning solution does not prevent metallization of the ABS surface of the bi-component plastic article whereas the metallization of the PCTA surface of the bi-component plastic article is effectively prevented (=selective metallization of ABS surfaces compared to PCTA surfaces). In addition, the metallization of the PVC surface of the rack is effectively prevented (=selective metallization of ABS surfaces compared to PVC surfaces). This allows the conclusion that the treatment of plastic articles with the rack conditioning solution after the etching step provokes a very selective metallization of surfaces comprising or consisting of ABS compared to other types of plastic surfaces (e.g. PCTA and PVC surfaces).

Example 15—Measurement by EDX and SEM Images of the ABS and PVC Surface after Treatment without Rack Conditioning The articles having a surface comprising or consisting of ABS are panels molded in ABS Novodur P2MC. The racks used for fixing the articles to be metalized have a PVC surface.

The result of the experiment is shown in FIG. 3, example 15. In fact, the metallization of the article with ABS surface was 100% and also the metallization of the rack with PVC surface (fixing the article with the ABS surface in each solution) was 100%.

From the EDX measurement made on the ABS and PVC surface immediately after rinse of the reduction step, only traces of sulfur element is detected both on the ABS surface and on the PVC surface due probably to pollution or background noise of the EDX measurement.

From the SEM pictures made on the ABS and PVC surface immediately after rinse of the reduction step, FIG. 4, example 15, a normal attack of the ABS surface can be observed by the creation of a porosity adapted to the metal anchoring. And nothing relevant is observed on the PVC surface meaning no crystal formation or modification of the PVC surface.

Example 16—Measurement by EDX and SEM Images of the ABS and PVC Surface after Treatment with Rack Conditioning without Thickening Agent The articles having a surface comprising or consisting of ABS are panels molded in ABS Novodur P2MC. The racks used for fixing the articles to be metalized have a PVC surface.

The result of the experiment is shown in FIG. 3, example 16. In fact, the metallization of the article with the ABS surface was 100% whereas the metallization of the rack with the PVC surface (fixing the article with the ABS surface in each solution) was 20% regardless.

From the EDX measurement made on the ABS and PVC surface immediately after rinse of the reduction/rack conditioning step, a sulfur content is increased about 2 times on the PVC surface compared to ABS surface. The sulfur content on the ABS surface remained substantially unchanged in comparison to the example 15.

From the SEM pictures made on the ABS and PVC surface immediately after rinse of the reduction/rack conditioning step, FIG. 5, example 16, a normal attack of the ABS surface can be observed by the creation of a porosity adapted to the metal anchoring. And nothing relevant is observed on the PVC surface meaning no crystal formation or modification of the PVC surface. But the content of sulfur present on the surface is able to limit the initiation of the electroless deposit.

Example 17—Measurement by EDX and SEM Images of the ABS and PVC Surface after Treatment with Rack Conditioning Containing the Thickening Agent The articles having a surface comprising or consisting of ABS are panels molded in ABS Novodur P2MC. The racks used for fixing the articles to be metalized have a PVC surface.

The result of the experiment is shown in FIG. 3, example 17. In fact, the metallization of the article with the ABS surface was 100% whereas the metallization of the rack with the PVC surface (fixing the article with the ABS surface in each solution) was 0%.

From the EDX measurement made on the ABS and PVC surface immediately after the rinse of the reduction/rack conditioning step, the sulfur content is highly increased on the PVC surface by the addition of the thickening agent in the rack conditioning step, when on the ABS surface, the sulfur content remained substantially unchanged in comparison to the examples 15 and 16.

From the SEM pictures made on the ABS and PVC surface immediately after the rinse of the reduction/rack conditioning step, FIG. 6, example 17, a normal attack of the ABS surface can be observed by the creation of a porosity adapted to the metal anchoring. The presence of crystal formation is observed on the entire PVC surface linked to the sulfur content strongly increased thanks to the thickening agent. This crystal formation is not observed on the ABS surface.

The invention claimed is:

1. A process for metallization of an article having a plastic surface comprising the steps of:

a) fastening the article to a rack;

b) etching the plastic surface with an aqueous etching solution free of $Cr^{6+}$, c) treating the etched plastic surface with a reducing agent; and d) metalizing the treated plastic surface;

wherein, after step c) or during step c), the plastic surface of the article and the rack are treated with an aqueous acidic rack conditioning solution which comprises water, at least one organosulfur compound, and at least one inorganic acid at a temperature from 25° C. to 70° C.

2. The process according to claim 1, wherein the at least one organosulfur compound is an organosulfur compound containing bivalent sulphur.

3. The process according to claim 2, wherein the organosulfur compound is represented by the formula R—SH, wherein R represents an organic group.

4. The process according to claim 2, wherein the organosulfur compound is selected from the group consisting of dithiocarbamates, 2-mercaptobenzimidazole, 2-mercaptobenzothiazole, 3-mercaptopropansulfonic acid sodium salt, thioglycolic acid, 3-(benzothiazolyl-2-mercapto)propyl sulfonic acid sodium salt, and mixtures thereof.

5. The process according to claim 1, wherein the at least one inorganic acid in the rack conditioning solution is selected from the group consisting of hydrochloric acid, sulphuric acid, phosphoric acid, and mixtures thereof.

6. The process according to claim 5, wherein the at least one inorganic acid is hydrochloric acid wherein the concentration of the hydrochloric acid in the rack conditioning solution is from 0.01 to 2 mol/L.

7. The process according to claim 1, wherein the reducing agent is added as a separate step by treating the rack with an aqueous reducing solution or the treatment is simultaneous to the treatment with the rack conditioning solution by adding the reducing agent to the rack conditioning solution.

8. The process according to claim 1, wherein the reducing agent is suitable to chemically reduce manganese compounds.

9. The process according to claim 8, wherein the reducing agent is selected from the group consisting of compounds having a hydroxylamine group, ascorbic acid, hydrazine, thiosulfate salts, and mixtures thereof.

10. The process according to claim 1, wherein the rack conditioning solution further comprises at least one thickening agent.

11. The process according to claim 10, wherein the at least one thickening agent is selected from the group consisting of polyvinyl alcohol, PEG, sodium alginate, polysaccharides, agarose, carboxymethylcellulose, and mixtures thereof.

12. The process according to claim 1, wherein the aqueous rack conditioning solution and/or an aqueous reducing solution comprising the reducing agent has a temperature of 25 to 70° C.; and/or the plastic surface is treated with the aqueous rack conditioning solution and/or aqueous reducing solution for 0.1 to 15 min.

13. The process according to claim 1, wherein the etching solution comprises $KMnO_4$ and phosphoric acid.

14. The process according to claim 1, wherein the plastic surface of the article at least partially comprises or consists of a plastic selected from the group consisting of acrylonitrile-butadiene-styrene, acrylonitrile-butadiene-styrene blends, polypropylene and mixtures thereof.

15. The process according to claim 1, wherein the rack does not comprise a plastic surface identical to the plastic surface of the article.

16. The process according to claim 1, wherein, before step b), the plastic surface is cleaned with a cleaning solution.

17. The process according to claim 1, wherein, after any one or all of steps a) to d) and the treatment with the rack conditioning solution the plastic surface is rinsed with water.

18. The process according to claim 1, wherein the metalizing of the treated plastic surface comprises at least one of the steps of:

i) treating the plastic surface with an aqueous acidic catalyst solution;

ii) treating the plastic surface with an aqueous acidic accelerator solution; and iii) treating the plastic surface with an aqueous alkaline solution for electroless deposition of a metal; and electrolytically depositing a metal on the surface having electroless-deposited metal.

* * * * *